US005434336A

United States Patent [19]

Adams et al.

[11] Patent Number: 5,434,336

[45] Date of Patent: Jul. 18, 1995

[54] PROCESS FOR THE DESTRUCTION OF EXPLOSIVES

[75] Inventors: Harold W. Adams, Monroe, Conn.; Albert Goldstein, Tinton Falls; James R. Hendricks, West Orange, both of N.J.

[73] Assignee: Sultech, Inc., Pittsburgh, Pa.

[21] Appl. No.: 210,816

[22] Filed: Mar. 21, 1994

[51] Int. Cl.[6] ..... C06B 21/00

[52] U.S. Cl. ..... 588/203; 588/202; 149/124

[58] Field of Search ..... 588/201, 202, 203; 149/124

[56] References Cited

U.S. PATENT DOCUMENTS

| | | | |
|---|---|---|---|
| 3,491,046 | 1/1970 | Pachuta | 524/705 |
| 3,793,235 | 2/1974 | Goebel | 521/46 |
| 3,884,884 | 5/1975 | Scoggins et al. | 528/360 |
| 3,919,177 | 11/1975 | Campbell | 528/373 |
| 4,231,822 | 11/1980 | Roth | 149/109.6 |
| 4,389,265 | 6/1983 | Tompa et al. | 149/109.6 |
| 4,581,442 | 4/1986 | Adams | 528/389 |
| 4,921,936 | 5/1990 | Adams | 528/389 |
| 4,990,404 | 2/1991 | Adams | 428/411.1 |
| 5,023,317 | 6/1991 | Adams | 528/389 |
| 5,032,291 | 7/1991 | Sublette | 210/757 |
| 5,347,072 | 9/1994 | Adams | 588/256 |

FOREIGN PATENT DOCUMENTS 49-127954 12/1974 Japan .
55-103646 7/1980 Japan .

OTHER PUBLICATIONS

"Chemical Stockpile Disposal Concept Plan", U.S. Army Toxic and Hazardous Materials Agency, Mar. 15, 1986.

Chemical Abstracts, vol. 85, No. 11, Sep. 13, 1976 p. 515, Ref. 77762n, U. S. S. Hae, "Reaction Between Diphenylsulphone and Elemental Sulfur and Detoxification of Polychlorinated Biphenyls", Gendai Kaguka, 1974.

*Primary Examiner*—Mgoclan Mai
*Attorney, Agent, or Firm*—Dickstein, Shapiro & Morin

[57] ABSTRACT

A process for stabilizing energetics, including explosives, propellants, pyrotechnics and obsolete munitions below detonation temperature by reaction with liquid sulfur. Also disclosed is a process for introducing sulfur into explosive packages without dismantling. The package is soaked in carbon disulfide solution and the solution is then evaporated, leaving behind elemental sulfur. After stabilization below the autodetonation temperature, the reaction products are completely destroyed by reaction with sulfur vapor at temperatures above 500° C.

22 Claims, 11 Drawing Sheets

PROCESS FOR THE DESTRUCTION OF EXPLOSIVES

FIELD OF THE INVENTION

This invention relates to a chemical process for safe destruction of energetics, including, but not limited to, explosives, propellants, pyrotechnics, chemical warfare agents and various obsolete munitions. The invention is directed to the destruction of energetic compounds and mixtures containing such compounds and also to the destruction of explosive packages, devices and waste materials that contain such compounds or mixtures.

BACKGROUND OF THE INVENTION

The demilitarization of aged explosives and propellants from obsolete munitions is a major concern due to potential contamination of the environment and the associated health and safety problems caused by toxic energetic materials during demilitarization operations. There is an urgent need to develop safe and environmentally acceptable techniques to destroy obsolete munitions and other energetic hazardous wastes.

U.S. Pat. No. 4,921,936 refers to a vaporized sulfur process for complete destruction of organic chemicals. According to column 3 of U.S. Pat. No. 4,921,936, the process:

> strips the carbon atoms out of such chemical carbonaceous compounds by subjecting the aforesaid carbonaceous chemical compound to vaporized sulfur, in a reaction chamber under an oxygen-free atmosphere at 500° to 1500° C., with the consequence that said vaporized sulfur combines directly with carbon atoms of the organic chemical to form solid particles of . . . inert polymer . . .

At temperatures well below the 500° C. referred to in U.S. Pat. No. 4,921,936 munitions and other energetic materials will spontaneously detonate.

A process is urgently needed for safe decomposition of various high explosives at temperatures below the trigger temperatures at which they spontaneously detonate.

SUMMARY OF THE INVENTION

It is an object of the invention to provide a process for decomposing explosives at temperatures below those at which they spontaneously and exothermically decompose.

A further object of this invention is the attainment of a process for environmentally acceptable hazardous waste management of obsolete munitions and other energetic military and industrial waste materials.

Another object of this invention is to provide a process that will substantially decompose explosives for safe subsequent processing at temperatures above their normal trigger temperatures, such as the processes disclosed in U.S. Pat. Nos. 4,581,442, 4,921,936, 4,990,404 and 5,023,317, each of which is hereby incorporated by reference herein in its entirety.

Yet another object of this invention is to provide a process for safe decomposition of ammunition and other explosive devices without the need for hand or machine dismantling of such devices.

Additional objects and advantages of the invention will be set forth in part in the description that follows, and in part will be obvious from the description, or may be learned by the practice of the invention. The objects and advantages of the invention will be attained by means of the instrumentalities and combinations particularly pointed out in the appended claims.

To achieve the objects and in accordance with the purpose of the invention, as embodied and described herein, the present invention provides a process for decomposing an explosive by reacting sulfur and the explosive together in a reactor under a substantially oxygen-free atmosphere at a temperature below the detonation or trigger temperature of the explosive and above about 110 degrees C. for a sufficient period of time to yield non-explosive reaction products, including a carbonaceous residue. Preferably an excess of sulfur to explosive, by weight, is supplied into the reactor. Most preferably the ratio of explosive to sulfur is in the range of from about 1:2 to about 1:10, or higher.

The explosive may be in the form of a military munition, a propellant, a chemical warfare agent, a pyrotechnic, or any explosive material, most preferably an explosive that contains one or more compounds having a nitro or nitrate substituent, such as TNT, HMX, RDX and PETN.

Where the compound is TNT, the reaction temperature may be in the range of from about 200° to 210° C. and maintained for less than about 5 hours, most preferably from about 2 to about 4 hours. Where the compound is RDX, the reaction temperature may be in the range of from about 180° to 200° C. and maintained for less than about 5 hours, most preferably from about 2 to about 4 hours. Where the compound is HMX, the temperature may be in the range of from about 190° to 220° C. and the period of time may be less than about 5 hours, most preferably from about 1 to about 4 hours. Where the compound is PETN, the temperature may be in the range of from about 140° to 175° C. and maintained for less than about 5 hours, preferably from about 2 to about 4 hours.

According to a particularly preferred embodiment, the non-explosive reaction products of the below detonation temperature reaction are then reacted with vaporized sulfur under a substantially oxygen-free atmosphere at a temperature in the range of from about 500° C. to about 1500° C. so as to form a chemically inert, solid composition of matter composed substantially of carbon and sulfur.

The sulfur may be fed into the reactor in the form of liquid sulfur. According to another preferred embodiment, which is especially useful in the case of munitions and other explosive packages, the sulfur is fed into the reactor together with a solvent. The preferred solvent is carbon disulfide. Where a solvent is used, it is preferably evaporated prior to reacting sulfur with the explosive as described above. In this embodiment, the explosive package or device need not be dismantled prior to decomposing the explosive.

According to an especially preferred embodiment, elemental sulfur is intimately mixed together with the explosive, the sulfur and explosive mix are then reacted under a substantially oxygen-free atmosphere, preferably nitrogen, at a temperature just below the detonation temperature of the explosive at a pressure of about 1 to about 2 atmospheres and for a sufficient period of time to yield non-explosive reaction products. Subsequently, vaporized sulfur and the non-explosive reaction products are reacted together under a substantially oxygen-free atmosphere, preferably nitrogen, at a temperature in the range of from about 500° C. to 1500° C. so as to form a chemically inert, solid composition of matter composed substantially of carbon and sulfur, thus resulting in the complete destruction of the explosive.

The invention also relates to the compositions of matter comprising the reaction products produced by the process.

DETAILED DESCRIPTION OF THE PREFERRED EMBODIMENTS

Figure 1:
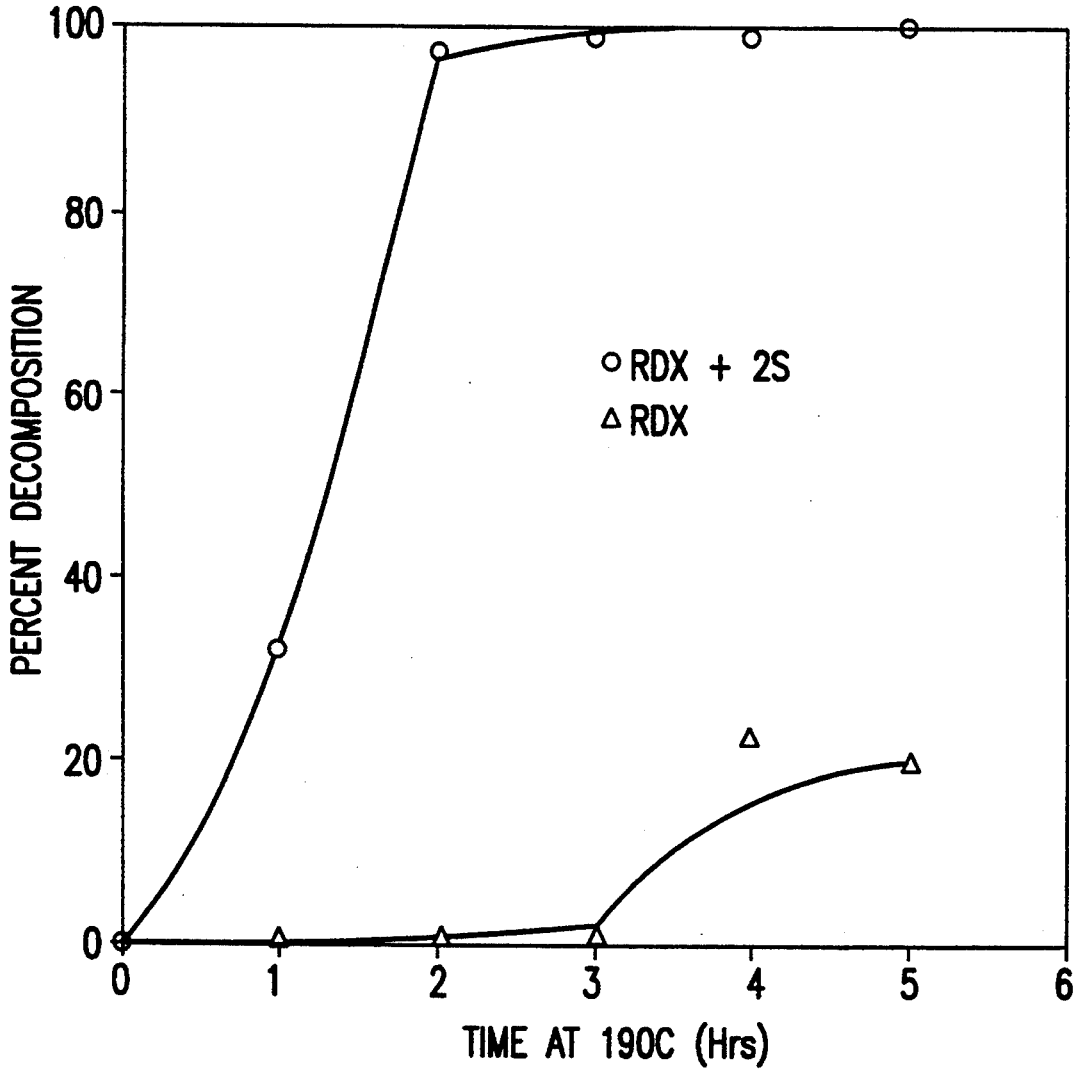
FIGS. 1 and 2 show the results of decomposition of RDX with and without sulfur at 190° and 180° C., respectively.

Reference will now be made in detail to the presently preferred embodiments of the invention, which, together with the following examples, serve to explain the principles of the invention.

We have discovered that explosives can be non-explosively decomposed by heating in the presence of elemental sulfur at temperatures below their spontaneous decomposition temperatures. The reaction yields gaseous products, which may be liquid at ambient temperature, and a non-explosive solid, carbonaceous residue. Similar non-exothermic decomposition reactions will occur when a broad variety of energetic materials, in particular those having nitro or nitrate substituents, are heated in the presence of elemental sulfur at temperatures below their normal spontaneous decomposition temperatures.

By "elemental sulfur" herein we mean sulfur in its pure form, in any of its naturally occurring states, as well as sulfur with minor amounts of contaminants as may be expected to occur in the sulfur recovered from a coal-fired power plant or in the various sulfur recycle streams in the processes of the present invention.

By "explosives" herein we mean all chemical compounds or their mixtures that rapidly, i.e., between about $10^{-3}$ to $10^{-6}$ seconds, produce large volumes of hot gases when properly initiated, such gases commonly being hydrogen, water, carbon monoxide, carbon dioxide and nitrogen as well as others. Explosives as used herein and which may be decomposed according to the process of the invention include, but are not limited tog nitramines, nitrocellulose, aliphatic nitrate esters, nitroglycerine, nitroaromatics, picric acid, tetetrazene, diazodinitrophenol, the entire family of materials known as propellants, the entire family of materials known as pyrotechnics, including fireworks, road flares, smoke grenades, riot control tear gases and others, all chemical warfare agents including, but not limited to, blister agents, nerve agents, incapacitating agents such as mustard, phosgene, lewisite, chemical agents BZ, VX, G, GA and GB, and similar compounds in the U.S. arsenal and international community of similarly constituted chemical warfare agents and mixtures containing any of the above or other explosives.

The explosives need not be in pure form or in the form of munitions and can be industrial propellants and other forms of non-military explosives and propellants, such as, for example, commercial blasting caps. The explosive can also be in the form of various explosive devices and packages, for example, incendiaries, mortar and artillery rounds and small arms cartridges of any kind. The explosives may be pure materials or mixtures of one another or constituted with various binders or contaminated with various amounts of other materials. The process of the invention will also deactivate trace amounts of explosives which are contaminants in other materials.

All of the above explosives will autodetonate at temperatures above the boiling point of elemental sulfur, and will autodetonate or will give rise to a significant danger of autodetonation at lower temperatures in the range of, for instance, about 200° C.

When explosives, for instance, TNT, RDX, HMX or PETN, are heated as in a differential scanning calorimeter, to 276° C., 216° C., 240° C., and 192° C., respectively, they decompose rapidly and in an exothermic manner. These materials, however, are reasonably stable, i.e., they do not rapidly lose the potential for spontaneous exothermic decomposition, when held at lower temperatures below about 200° C. When explosives are held at temperatures below about 200° C. in admixture with elemental sulfur a decomposition reaction occurs which results in the generation of carbon monoxide, carbon dioxide, water and one or more of the nitrogenous gases: nitrous oxide, nitrogen dioxide and nitric oxide. With the exception of certain explosives such as PETN, which leave little or no residue, the reaction also results in a carbonaceous residue, which is comprised substantially of carbon and thus is not entirely the same as the carbon-sulfur polymer end product of U.S. Pat. No. 4,921,936.

According to the process of the invention, the sulfur is preferably in close and intimate contact with the explosive. The intimate mixture is then heated to an elevated temperature, preferably 180° C. or higher, but not as high as the autodetonation temperature for the explosive, and maintained at the elevated temperature for a sufficient period of time to decompose the explosive. Following such treatment the system can be heated to higher temperatures without any sign of detonation or similar exothermic reaction.

By the term "decompose" with respect to the explosive in the context of the invention, the term means that the explosive is chemically altered by reaction with sulfur at least to the extent that the explosive reactant substantially loses its normal shock or thermal sensitivity; according to a preferred embodiment the decomposed explosive can then be further reacted with sulfur vapor at elevated temperatures in the range of about 500° C. or higher without detonating.

Loose explosives in powder or granular form can be suitably and intimately mixed with sulfur by any technique that does not generate hot spots in the mixture. Such techniques include, for example, refrigerated pin mixers, ribbon blenders and the like. Such mixing of elemental sulfur with ammunition or other explosive devices, however, is sometimes impractical, since there is some danger of explosion, particularly if the device is to be completely dismantled or if hand- or machine-mixing with sulfur were to be attempted. Under such circumstances the elemental sulfur is preferably introduced into the interior of the device or explosive package as liquid sulfur or as a solution in a solvent such as carbon disulfide alone or together with other solvents such as dioxane, tetrahydrofurane, dimethylformamid, toluene, carbon tetrachloride and naphtha. In addition, such solution or liquid sulfur is preferred for use with waxy or cast explosives which can be melted by the solution or liquid sulfur so as to form an intimate mixture. Upon flooding the device or explosive package or submerging in such solution, the solution is able to penetrate all of the interstices of the device or explosive package while still at ambient temperature or even below ambient.

Once the penetration is complete, which is typically a matter of a few hours at atmospheric pressure, depending upon the particular device, the solvent is evaporated from the device or explosive package. This can be accomplished at ambient temperature by application of vacuum or at somewhat elevated temperatures and atmospheric pressure. For example, the boiling point of carbon disulfide is 46.5° C./760 mm and evaporation is readily and safely accomplished at about 50° C./760 mm. The elemental sulfur will remain behind in the explosive package when the solvent evaporates, yielding a system in which the explosive is in intimate contact with the elemental sulfur, a system well suited for the process described above for decomposition of the explosive.

In the case of meltable, waxy explosives which can be melted and cast to the desired shape, the explosive can be melted and then mixed with liquid sulfur to form an intimate mixture. The reactants can be mixed by methods known in the art, such as paddle and rotary mixers, screw mixers and star feed mixers, whether in liquid or powder form.

The process of the invention is also readily adaptable to the various types of feed streams produced from the dismantling of obsolete weapons. For example, feed streams from the dismantling operation, including metallic parts, are fed to the reactor under an inert atmosphere, preferably, nitrogen. In the reactor section, metallic parts and liquid sulfur are combined, flooding each component to achieve intimate mixing and contact. After a period of time sufficient to substantially decompose the explosive component at a temperature below the trigger temperature of the explosive, the parts may then be moved to a higher temperature section of the reactor, wherein vaporized sulfur completes the reaction. The metallic residue is cooled and then removed in a batch process.

The reaction rates are dependent upon temperature. Use of relatively crude temperature controls would of course mandate that the temperatures be held 20° to 30° C. lower than the spontaneous decomposition temperatures. In standard commercial or similar use, the reactions can, however, be controlled precisely within ±1.5° C. while increasing the temperatures, such that a reaction time of less than one hour can be safely obtained. Such controls permit the use of relatively higher temperatures and hence reduced reaction times. The sensors and close control mechanisms for increasing temperature gradually under a high degree of control (below the trigger temperature) are well known to those of ordinary skill in the art, and can be used to achieve safe and efficient decomposition of explosives given the teachings herein. In the preferred embodiment, the reaction temperature is in the range of from 1.5° to 20° C. below the autodetonation temperature for the particular explosive reactant, most preferably about 1.5° to 10° C. below that temperature.

After several hours at or below about 200° C., virtually 100% of the explosive is safely decomposed. The gaseous reaction products and the solid reaction products are then subjected to high temperature sulfur vapor according to the process of U.S. Pat. No. 4,921,936 and its related patents. In the sulfur vapor stage of the reaction, the reaction time is in the order of seconds or less. During the high-temperature stage on the gaseous and solid products, over 98% of all of the organics are destroyed and efficiencies can be much higher with the use of recycle and multiple reactor stages.

The carbon-sulfur residue is separated from any vapor phases in the reactor by means known in the art. The residue is non-toxic and can be landfilled. The excess sulfur is preferably condensed and recycled back to the sulfur system. Gaseous products generated by the process include a variety of sulfur compounds and acid gases that can be collected and treated in a conventional off-gas treatment system. For example, products from chemical warfare agents include carbon disulfide, carbonyl sulfide, hydrogen sulfide, sulfur dioxide, sulfur fluorides, sulfur chlorides, and phosphorous sulfides. All can be treated easily with caustic by methods known in the art or are inert. Purge nitrogen is preferably treated with caustic before being recycled. Quantities of each of these products depends on the stoichiometry of the total organic material being fed to the reactor.

The gaseous products coming from the reactor and any cool-down sections are preferably passed through a condensing zone where excess sulfur, and products such as carbon disulfide and sulfur chlorides, are successively condensed. Recovered excess sulfur is preferably recycled to the reactor. The liquid products may be recovered or neutralized with caustic for disposal. The vapors exiting the condenser section may be passed through a conventional off-gas treatment system to remove hydrogen sulfide and other acid gases, resulting in effluent emissions which comply with EPA standards.

The process of the invention for destruction of obsolete munition systems is advantageous in that the energetics are safely decomposed at low temperatures; rapid destruction of residual organic materials occurs at temperatures above 50° C.; the reaction products are simple sulfur compounds that can be safely collected or treated; and the process is amenable to atmospheric pressure operation. A wide variety of explosive compounds react with elemental sulfur at temperatures below the 500° C. temperature used in the last stage of the preferred process. The products of these reactions are simple sulfur compounds such as carbon disulfide, hydrogen sulfide, sulfur oxide, sulfur chlorides, based on the elements contained in the explosive reactant.

It is to be understood that the application of the teachings of the present invention to a specific problem or environment will be within the capability of one having ordinary skill in the art in light of the teachings contained herein. Examples of the processes of the present invention and their use appear in the following examples.

EXAMPLE 1

This example employs representative explosives in the current inventory of obsolete munitions.

1,3,5-trinitro-1,3,5-triazacyclohexane (RDX), 1,3,5,7-tetranitro-1,3,5,7-tetrazacyclooctane (HMX), 2,4,6-trinitrotoluene (2,4,6-TNT), and pentaerythritol tetranitrate (PETN) were chosen to represent nitramine, nitroaromatic, and nitrate ester explosives.

Apparatus

Perkin-Elmer DSC-4 Differential Scanning Calorimeters, a Perkin-Elmer DTA Differential Thermal Analyzer, a Varian VISTA 5500 Liquid Chromatograph, a Beckman FT 1100 Fourier Transform Infrared Spectrometer, a Dionex 4000i Ion Chromatograph, and a Finnigan OWA 1020B Gas Chromatograph/Mass Spectrometer were used.

Explosives

The representative explosives, i.e., RDX, HMX, 2,4,6-TNT, and PETN were Military Grade without further purification.

Reagents

The solvents and reagents used were high performance liquid chromatography Grade or Reagent Grade without further purification.

RESULTS AND DISCUSSION

Experimental Approaches and Rationale

The experiment was conducted in two phases. In the first phase, only 5 mg aliquots of energetic materials were used to study the reaction of RDX, HMX, 2,4,6-TNT, and PETN with sulfur in a 1:2 ratio as a function of temperature and time by isothermal differential scanning calorimetry (DSC). In all cases, the sample consisted of approximately 5 mg explosive and 10 mg sulfur. The DSC experiments were conducted in a high pressure gold-plated stainless steel cell with the maximum capacity of approximately 15 mg. The heated samples were extracted with acetonitrile for the determination of the remaining explosive by high performance liquid chromatography (HPLC).

This established the temperature and time conditions for safe and complete destruction of the four representative high explosives, prior to undertaking the subsequent investigation using larger amounts of specimens. In the second phase of this study, the experimental scale was increased 100 fold in order to simulate the reaction of bulk quantity of energetic materials with excess sulfur.

A muffle furnace with continuous sample temperature recording was used to repeat the study of the reaction of RDX, HMX, 2,4,6-TNT, and PETN with sulfur in the 1:2 ratio as a function of temperature and time. In the beginning, the conditions established in the earlier DSC studies were used as a guide and the conditions were modified as needed to achieve safe and complete destruction of explosives. In all cases, the sample which was carefully and thoroughly mixed, consisted of approximately 500 mg explosive and 1000 mg sulfur in the initial investigations. This ratio was changed during the course of study and a final ratio of 1:10 (explosives vs. sulfur) was used in the later stages of experiments. Initially, the sample was heated in an open platinum crucible. Subsequently, an aluminum container with a tight cover was employed for mechanical strength, ease of cleaning following an experiment, and for collection of gaseous products. The heated samples were extracted with acetonitrile for the determination of the remaining explosive by high performance liquid chromatography (HPLC).

Results and Discussion

Phase 1 (5 mg Scale)

a. RDX

The studies were conducted at 150°, 160°, 170°, 180°, and 190° C. for up to 5 hrs. At or below 170° C., the decomposition of RDX was not observed in the samples or the controls.

Figure 2:
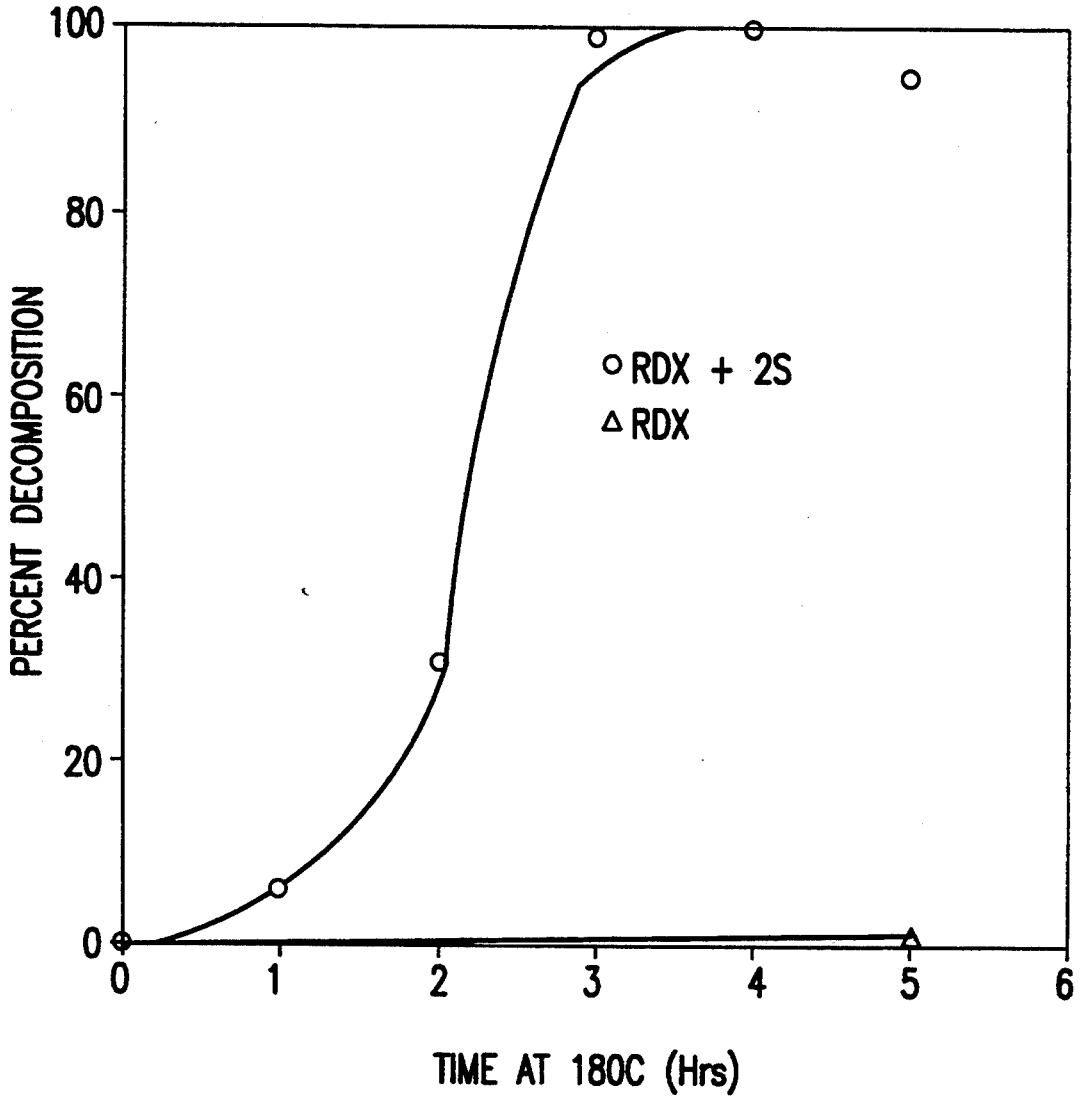

The results at 190° and 180° C. are summarized in FIGS. 1 and 2, respectively. At 190° C., RDX decomposed completely after 2 hours in the presence of excess sulfur, while RDX in the controls showed significant decompositions only after heating for longer than 3 hours. FIGS. 1 and 2 indicate that RDX decomposes with an induction period.

At 180° C., RDX decomposed completely after 3 hours in the presence of excess sulfur, while RDX controls showed no significant decomposition at all even after heating for 5 hours. The results established that excess sulfur causes complete decomposition of RDX at 180° and 190° C. after 3 and 2 hours, respectively.

b. HMX

Figure 3:
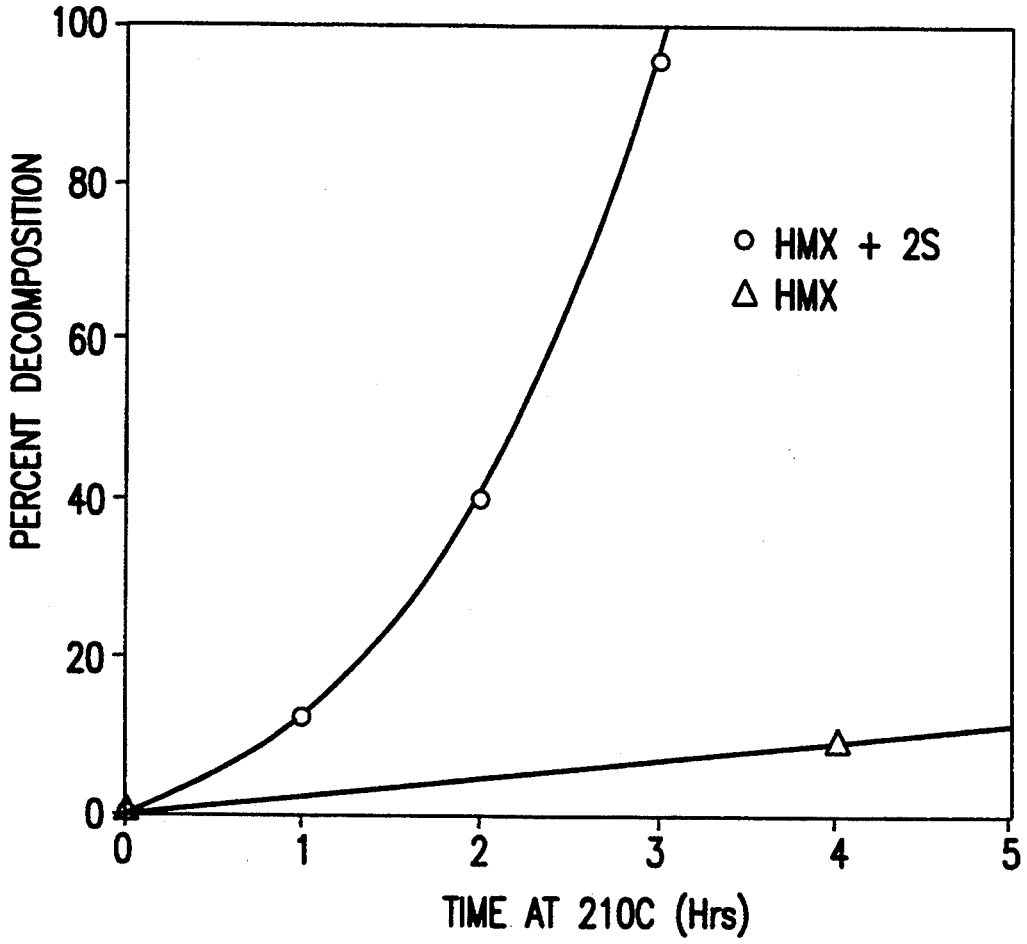
FIGS. 3 and 4 show the results of decomposition of HMX with and without sulfur at 210° and 220° C., respectively.
Figure 4:
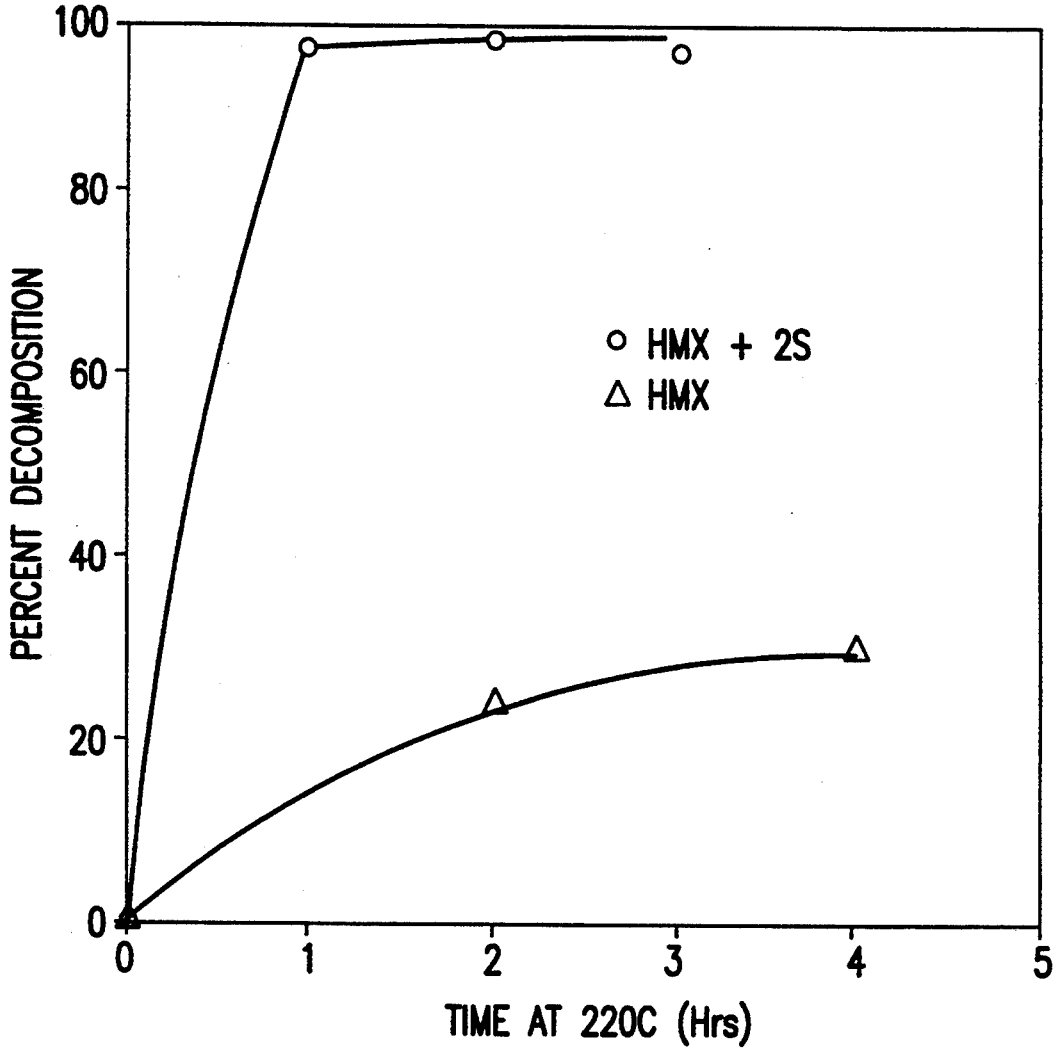

The experiments were conducted in the temperature range of 190° to 220° C. in 10° C. increments. It has been established that the control does not decompose at 190° C. and decomposes at 200° C. to the extent of about 5% even after 5 hours, while HMX reacts with sulfur to the extent of about 10% at 190° C. after 2 hours and nearly completely at 220° C. after about one hour. FIGS. 3 and 4 summarize the results obtained at 210° and 220° C., respectively. It is readily seen that excess sulfur accelerates the decomposition of HMX greatly as in the case of RDX. Clearly, HMX decomposes completely at 220° C. after about an hour.

c. 2,4,6-TNT

Figure 5:
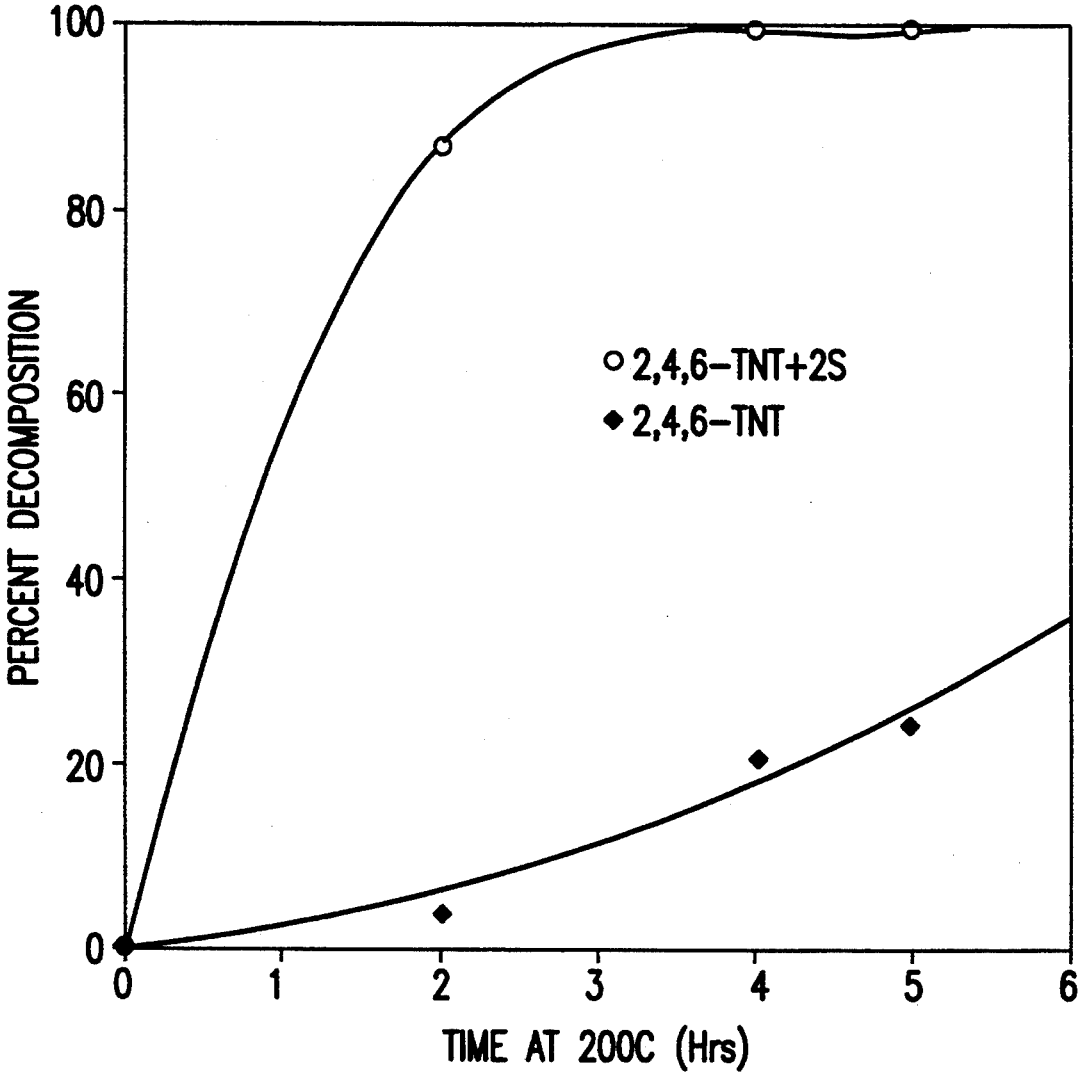
FIGS. 5 and 6 show the results of decomposition of 2,4,6-TNT with and without sulfur at 200° and 210° C., respectively.
Figure 6:
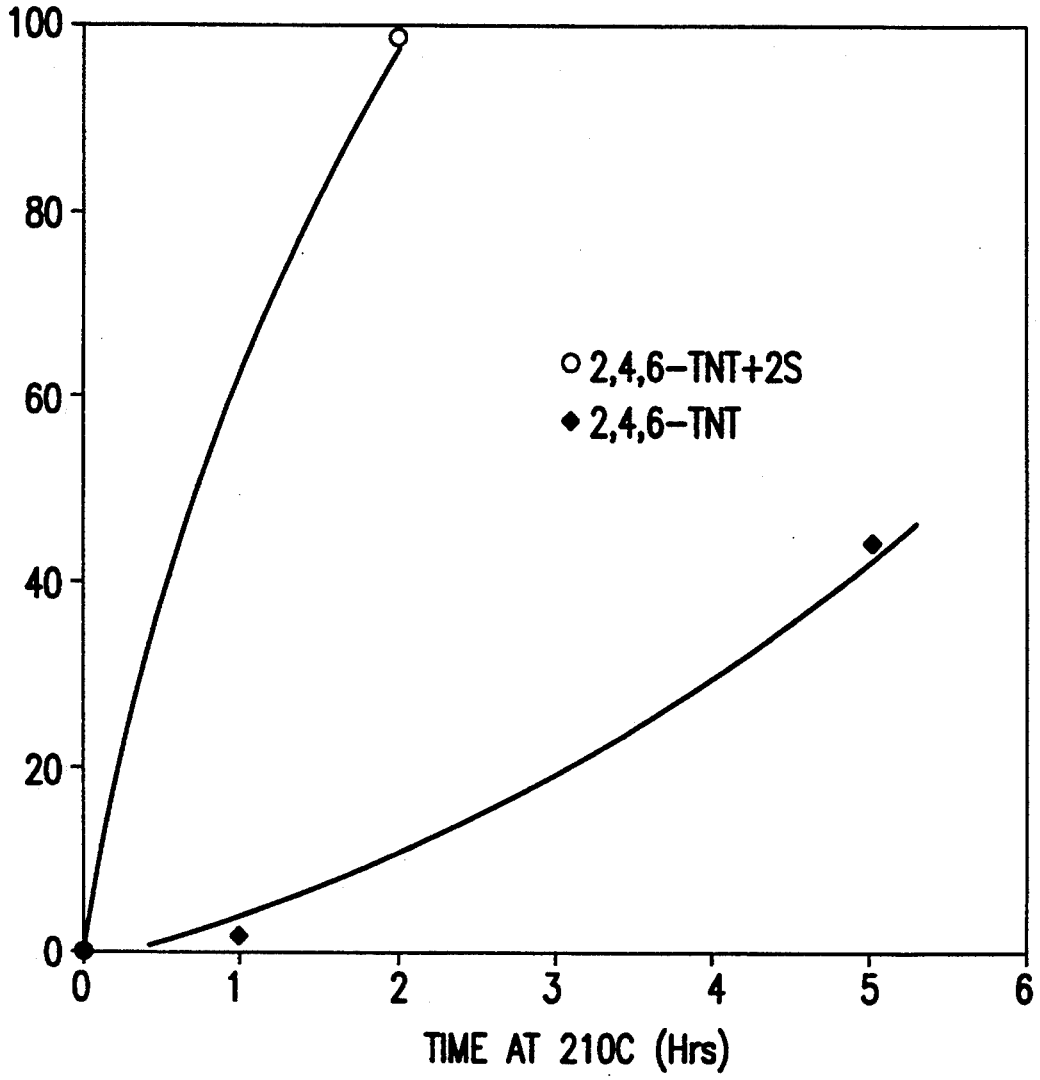

The experiments were conducted at 180° C. to 210° C. in 10° C. increments. At 180° C., the control does not decompose at all even after 5 hours, while 2,4,6-TNT reacts with sulfur to the extent of about 10% at 180° C. after 4 hours. FIGS. 5 and 6 summarize the results obtained at 200° and 210° C., respectively. Sulfur accelerates the decomposition of 2,4,6-TNT greatly and after about 3 and 2 hours, the decomposition is essentially complete at 200° and 210° C., respectively.

d. PETN

Figure 7:
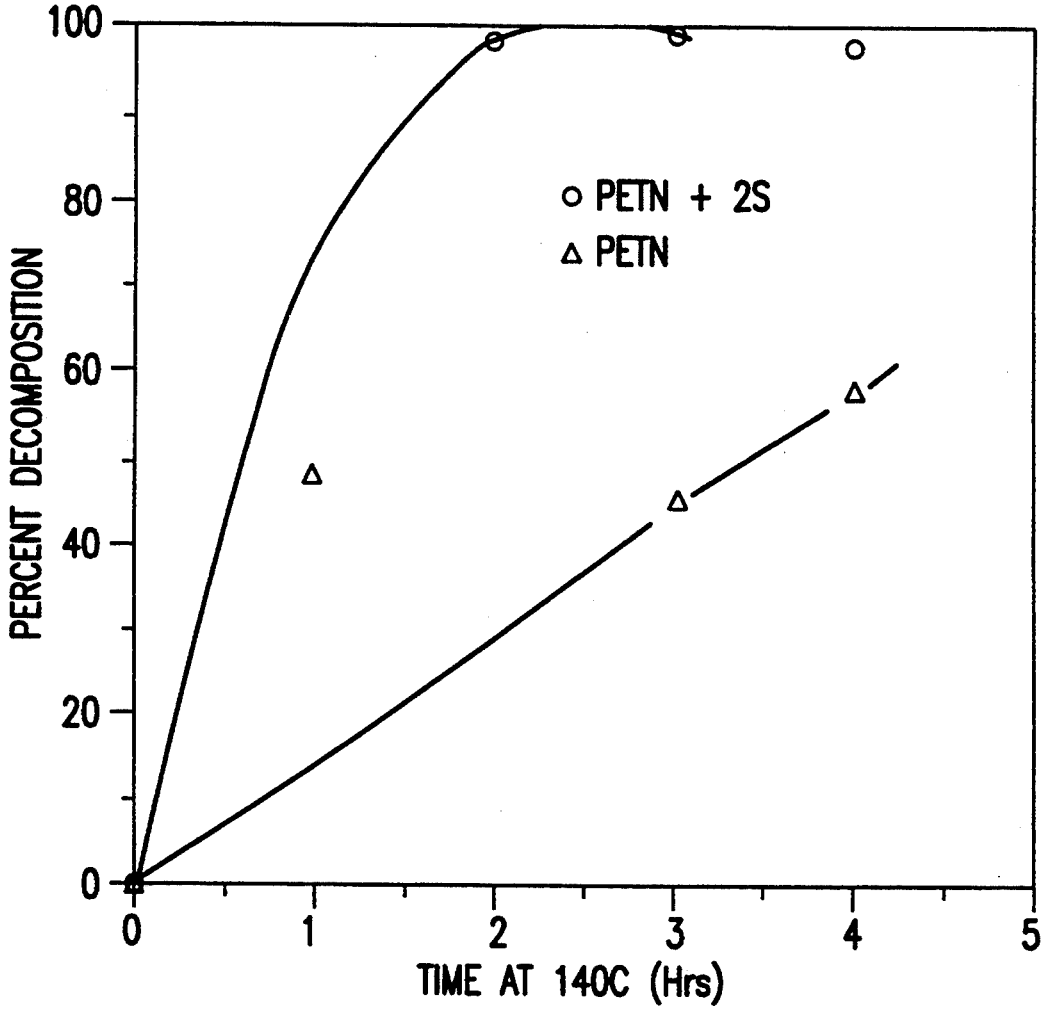
FIG. 7 shows the results of decomposition of PETN with and without sulfur at 140° C.
Figure 8:
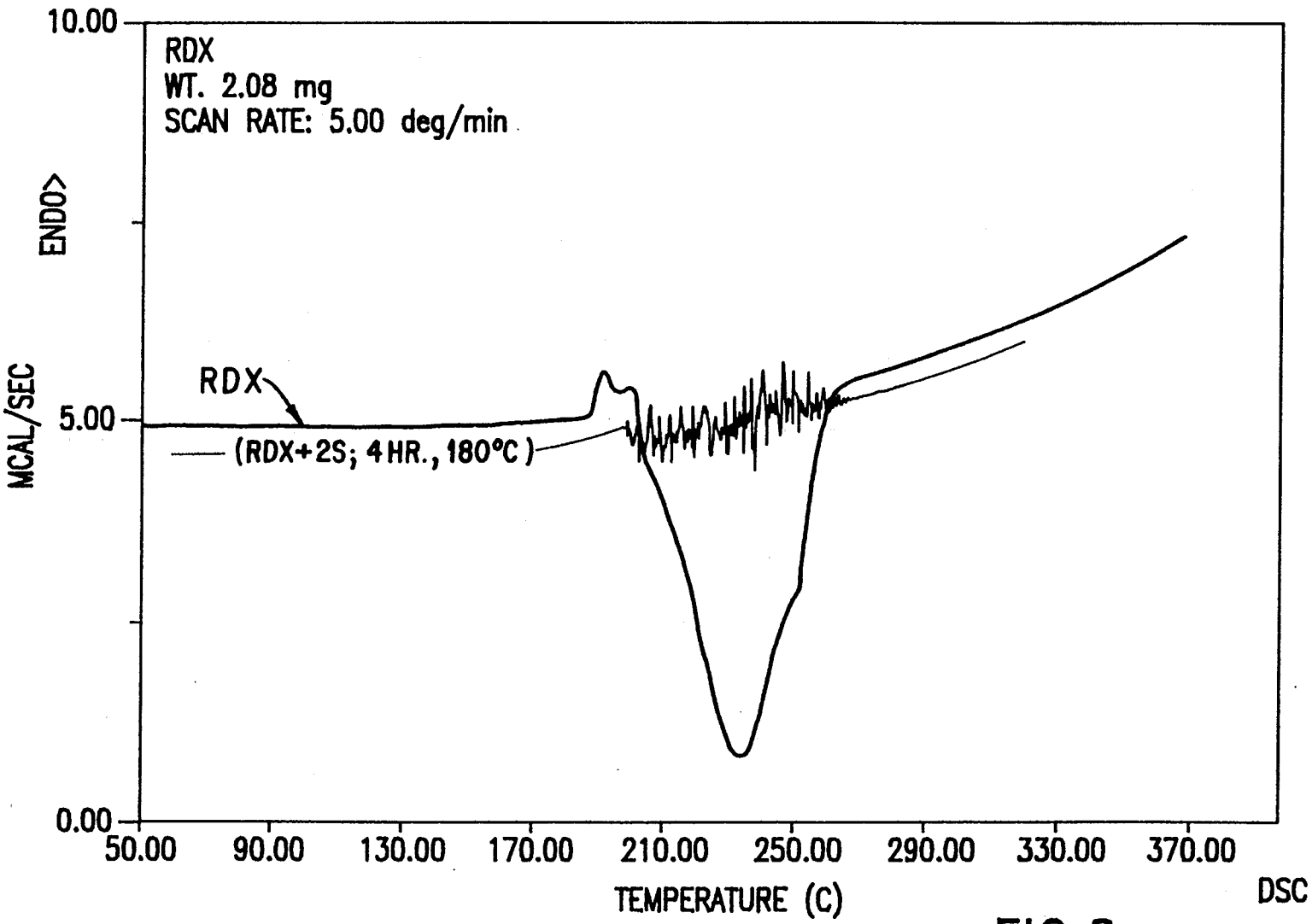
FIGS. 8, 9, 10 and 11 exhibit the DSC thermograms of, respectively, RDX, HMX, 2,4,6-TNT, and PETN in the linear temperature programming mode with and without sulfur, with 5.00° C./min. scan rate, clearly exhibiting the decomposition.
Figure 9:
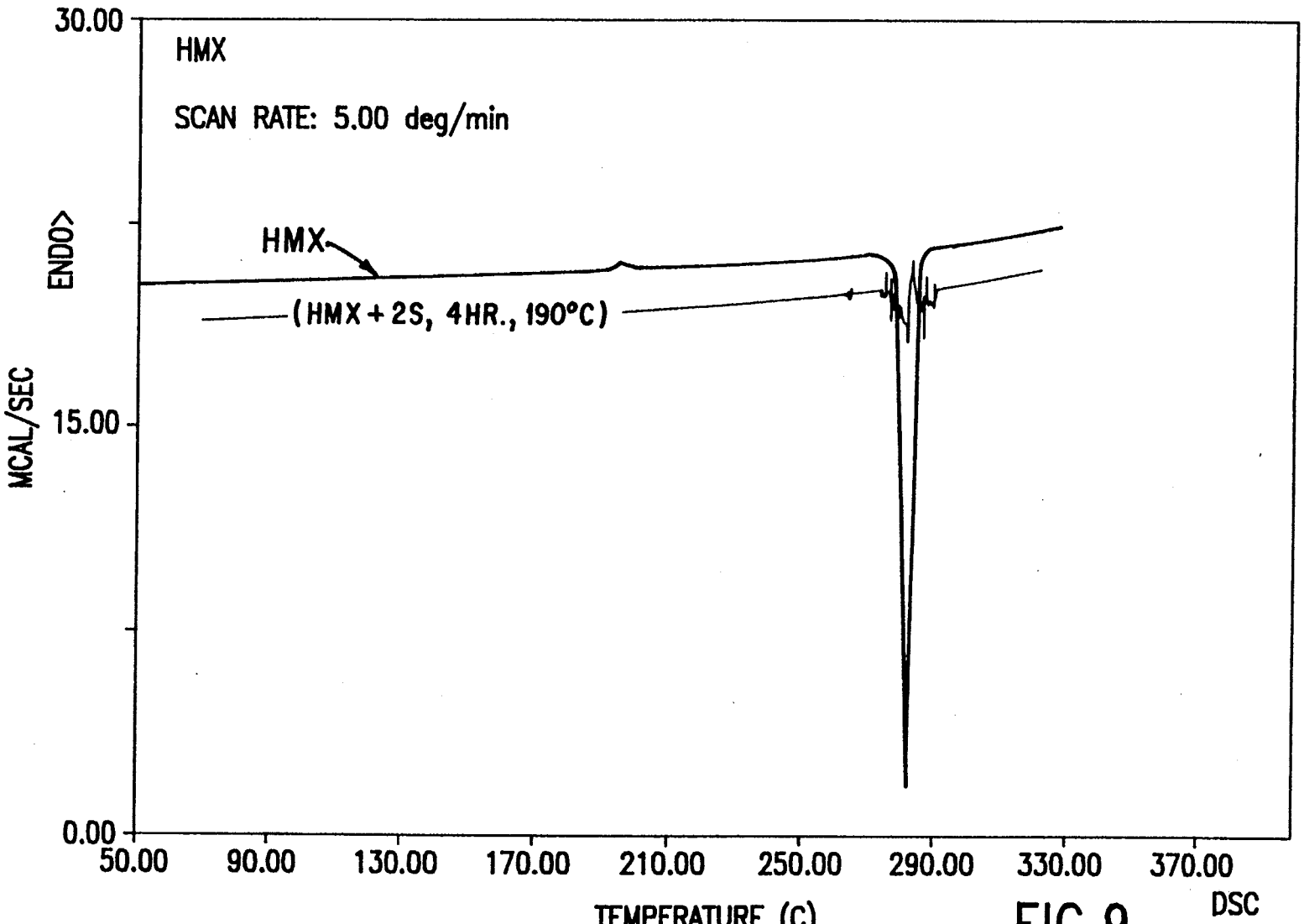
Figure 10:
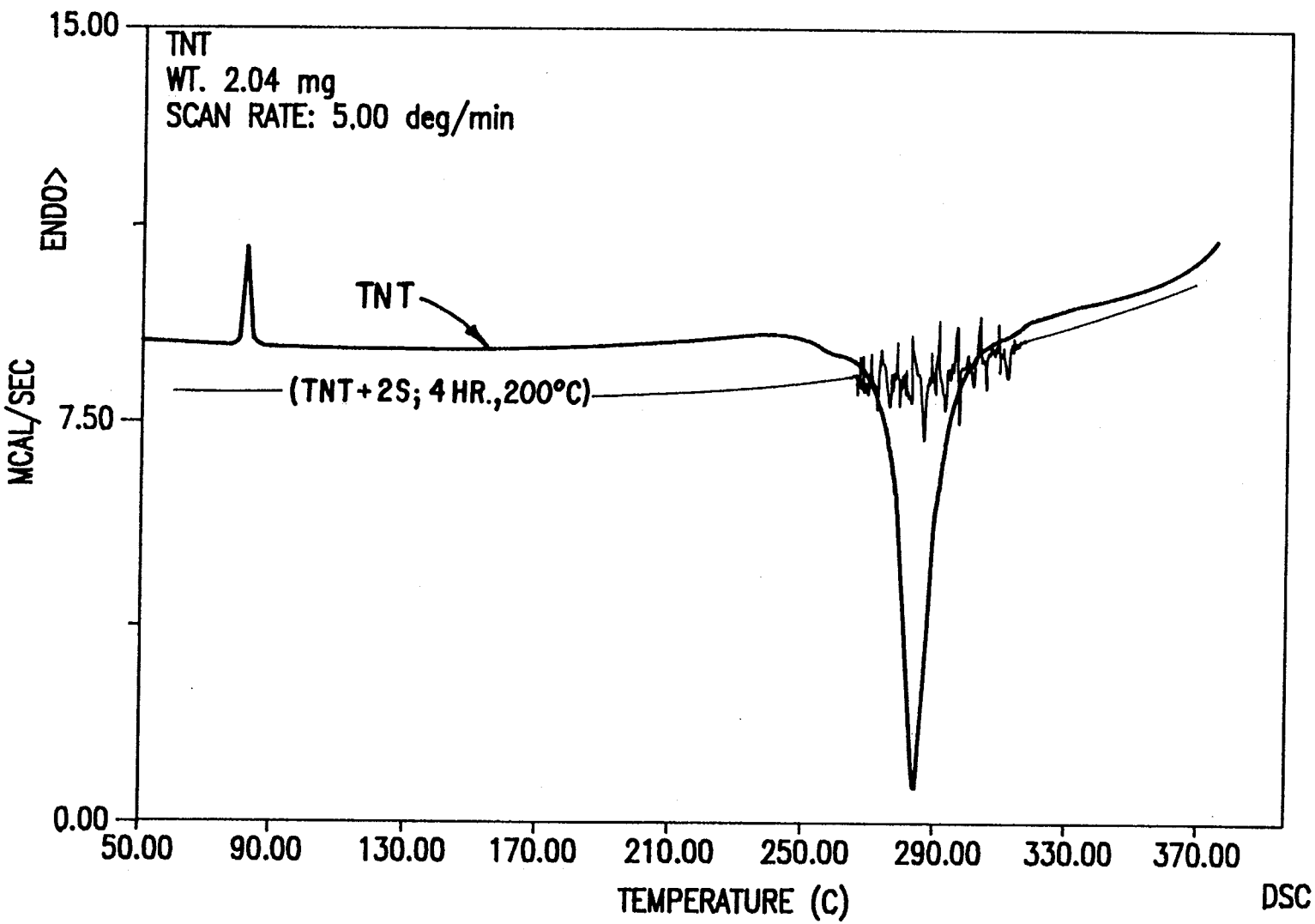
Figure 11:
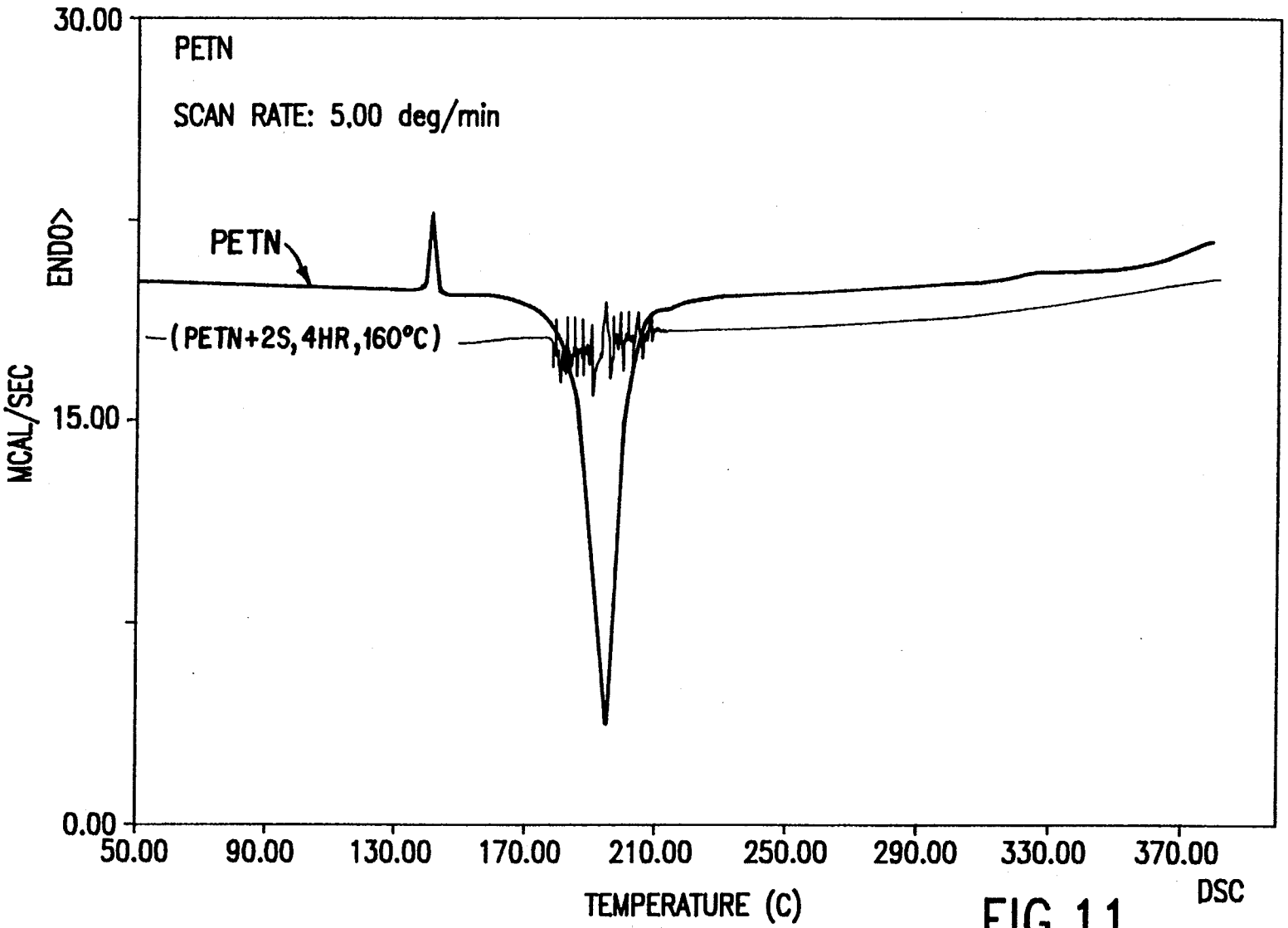

The experiments were conducted from 140° C. to 180° C. in 10° C. increments. The more labile PETN decomposes much more readily than the other explosives in the example. Thus, at 140° C., complete decomposition is attained in approximately 2 hours in the presence of sulfur (see FIG. 7).

FIGS. 8, 9, 10, and 11 exhibit the DSC thermograms of, respectively, RDX, HMX, 2,4,6-TNT, and PETN in the linear temperature programming mode with 5.00° C./min. scan rate.

Phase II (500 mg scale)

a. RDX

In order to assure the occurrence of runaway condition could be avoided we diluted RDX with excess sulfur, higher ratios of sulfur to energetic materials, i.e., 5:1 at first, then 10:1 eventually in later experiments were used.

As indicated by the DSC studies, RDX was found to react with sulfur essentially to completion at 190° C. after about 2 hours. In order to insure complete decomposition of RDX, the heating was extended to five hours.

b. HMX

Again, the heating conditions established in the DSC studies proved to be reliable. Thus, 100% decomposition of HMX could be effected at 220° C. after four hours. The heating period was extended to five hours to insure complete decomposition.

c. 2,4,6-TNT

Since the heating parameters established by DSC studies for RDX and HMX proved to be correct, heating was carried out, based on DSC findings, at 210° C. for five hours.

d. PETN

The heating conditions used were based on DSC studies, i.e., 140° C. and five hours.

Reaction Product Identification and Quantification

Gaseous products predominate the reaction products observed. Thus, these products accounted for about 75, 100, and 80% of the original weight of PETN, RDX, and 2,4,6-TNT, respectively. The products observed or identified include nitrogen dioxide, nitrous oxide, carbon dioxide, sulfur dioxide, and water.

The residue from PETN was yellowish and insoluble in carbon disulfide. This was identified to be mostly the second form of monoclinic cyclooctasulfur (gamma-sulfur or mother-of-pearl sulfur). Direct exposure probe mass spectrum of this residue in the positive ion chemical ionization mode using approximately 3 to 5 torr methane as the reagent gas identified the residue to be primarily cyclooctasulfur from the observation of the protonated molecular ion, m/z=257, and its fragment ions through successive losses of one sulfur atom to form ions with m/z of 225, 193, 161, and 129.

The residues from RDX and 2,4,6-TNT were brownish and black, respectively and appear to be mixtures of gamma-sulfur and carbonaceous materials. The sulfur content in the latter is estimated to be much higher than that in the former.

Material Balance

The quantitation is based on ion chromatography (IC) and gas volume measurement following scrubbing of gas mixtures for nitrous oxide determination. A gas scrubber containing 20 ml 1.9M aqueous solution of sodium hydroxide and a simple gas collecting device were connected in series to capture nitrogen dioxide, other $NO_x$'s except nitrous oxide, carbon dioxide, sulfur dioxide and nitrous oxide, respectively.

The solid residues were washed thoroughly with carbon disulfide to remove all soluble forms of sulfur.

a. PETN

The scrubber weight gain and the nitrous oxide accounted for approximately 90% of gaseous products. The nitrite ion, nitrate ion, and sulfate ion contents in the scrubber amounted to about 70% of the scrubber weight gain. The nitrite ion was the major species observed and represented approximately 84% of the latter. In contrast to the large amount of gamma-sulfur observed (about 60% of the original amount of PETN) in the solid residue, the amount of the carbonaceous material was quite small.

b. RDX

The scrubber weight gain and the nitrous oxide accounted for approximately 67% of gaseous products. The nitrite ion, nitrate ion, and sulfate ion contents in the scrubber amounted to about 70% of the scrubber weight gain. The nitrite ion was again the major species observed as in the case of PETN and represented approximately 64% of the latter. The solid residue, which amounted to about 20% of the original amount of RDX, appears to consist of gamma-sulfur and carbonaceous material.

c. 2,4,6-TNT

The scrubber weight gain and the nitrous oxide accounted for approximately 79% of gaseous products. The solid residue, which amounted to about 100% of the original amount of 2,4,6-TNT, appears to consist of a high percentage of gamma-sulfur and a small amount of carbonaceous material.

SUMMARY

Excess sulfur accelerates greatly the complete decomposition of RDX, HMX, 2,4,6-TNT and PETN. The preferred temperatures and heating periods are 190° C. and 5 hours for RDX, 220° C. and 5 hours for HMX, 210° C. and 5 hours for 2,4,6-TNT, and 140° C. and 5 hours for PETN for complete decomposition.

Complete decomposition of explosives can be safely undertaken provided that temperature of the reactants is precisely controlled (preferably approximately ±1.0° C. or better) and the reactants are thoroughly and intimately mixed to avoid runaway conditions.

The reaction products are mainly gaseous and they account for approximately 75 to 100% of the original weight of the specimen. The products observed or identified include nitrogen dioxide, nitrous oxide, carbon dioxide, sulfur dioxide, and water. The carbon disulfide insoluble solid residues consist of the second form of monoclinic cyclooctasulfur (gamma-sulfur or mother-of-pearl sulfur) and carbonaceous materials.

The semi-quantitative material balance of the gaseous products based on scrubber and gas collection accounted for approximately 76 to 90% of the weight losses.

EXAMPLE 2

0.5 g of TNT was mixed with 5.0 g of powdered sulfur and placed in a 50 ml stainless steel crucible equipped with a screw-cap closure, which was sealed against gas transfer by a strip of Teflon tape on the threads. The screw cap was equipped with a thermocouple well and a tube fitting. This unit was placed in a muffle furnace and heated to 210° C., which is 66° C. below the spontaneous decomposition temperature of TNT (276° C.).

A brown colored gas, later determined to be a mixture of $NO_2$ and $N_2O$, was formed rather rapidly, followed by the development of other, non-colored gases. The latter gases were determined to be a mixture of CO, $CO_2$ and water. A black carbonaceous residue remained in the reactor when it was later examined after cooling.

In a test in which the crucible was heated above 280° C., following 4 hour aging at 210° C., the normally-expected explosive decomposition reaction failed to occur.

EXAMPLE 3

0.5 g of RDX and 5.0 g of powdered sulfur were reacted, as in the manner of Example 2 above, at 200° C., yielding the same mixture of gases, as determined in a non-quantitative manner. No spontaneous decomposition reaction occurred when the residue was heated above 216° C., its normal decomposition temperature.

EXAMPLE 4

0.5 g of HMX and 5.0 g of powdered sulfur were reacted, as in the manner of Example 2 above, at 190° C., yielding the same mixture of gases, as determined in a non-quantitative manner. No spontaneous decomposition reaction occurred when the residue was heated above 240° C., its normal decomposition temperature.

EXAMPLE 5

0.5 g of PETN and 5.0 g of powdered sulfur were reacted, as in the manner of Example 2 above, at 175° C., yielding the same mixture of gases, as determined in a non-quantitative manner. Only a trace of carbonaceous residue was observed when the crucible was cooled and opened and no spontaneous decomposition reaction occurred when the residue was heated above 192° C., its normal decomposition temperature.

EXAMPLE 6

A 50% solution of sulfur in carbon disulfide is prepared. An explosive package consisting of a case of 0.50 cal Browning cartridges with the projectiles removed is immersed in the carbon disulfide solution and soaked for 24 hours at ambient temperature.

After 24 hours, the carbon disulfide is drained and then evaporated from the explosive package by heating the package to 50° C. and maintaining this temperature for 2 hours.

The explosive package is then heated to 180° C. in an inert atmosphere of nitrogen, at 1–2 atmospheres. The temperature is maintained for 5 hours, resulting in substantial decomposition of the explosive component.

EXAMPLE 7

The decomposed package of Example 6 above is then heated to a temperature of 550° C. and reacted with vaporized sulfur according to the process disclosed in U.S. Pat. No. 4,921,936. As a result, the explosive components within the package are completely destroyed to yield an inert polymer useful for various coating and filler purposes.

It will be apparent to those skilled in the art that various modifications can be made to the processes of the present invention. Thus, it is intended that the present invention covers the modifications and variations of this invention provided they come within the scope of the appended claims and their equivalents.

We claim:

1. A process for decomposing an explosive, said process comprising the step of reacting sulfur and said explosive together in a reactor under a substantially oxygen-free atmosphere at a reaction temperature above about 110 degrees C. and below the autodetonation temperature of said explosive for a sufficient period of time to yield reaction products comprising a carbonaceous residue.

2. The process of claim 1 wherein an excess of sulfur to said explosive, by weight, is supplied into said reactor.

3. The process of claim 2 wherein the ratio of explosive to sulfur is in the range of from about 1:2 to about 1:10.

4. The process of claim 1 wherein said reaction temperature is in the range of between about 20 to about 1.5 degrees C. below the autodetonation temperature of said explosive.

5. The process of claim 1 wherein said explosive is in the form of a military munition.

6. The process of claim 1 wherein said explosive is a propellant.

7. The process of claim 1 wherein said explosive is a chemical warfare agent.

8. The process of claim 1 wherein said explosive is a pyrotechnic.

9. The process of claim 1 wherein said explosive contains one or more compounds having a nitro or nitrate substituent.

10. The process of claim 9 wherein said compound is selected from the group consisting of TNT, HMX, RDX and PETN.

11. The process of claim 10 wherein said compound is TNT, said reaction temperature is in the range of from about 200° to 210° C. and said period of time is less than about 5 hours.

12. The process of claim 10 wherein said compound is RDX, said reaction temperature is in the range of from about 180° to 200° C. and said period of time is less than about 5 hours.

13. The process of claim 10 wherein said compound is HMX, said reaction temperature is in the range of from about 190° to 220° C. and said period of time is less than about 5 hours.

14. The process of claim 10 wherein said compound is PETN, said reaction temperature is in the range of from about 140° to 175° C. and said period of time is up to about 5 hours.

15. The process of claim 1 further comprising the subsequent step of reacting sulfur and said reaction products together under a substantially oxygen-free atmosphere at a temperature in the range of from about 500° C. to about 1500° C. so as to form a chemically inert, solid composition of matter composed substantially of carbon and sulfur.

16. The process of claim 1 wherein said sulfur is fed into said reactor in the form of liquid sulfur.

17. The process of claim 1 wherein said sulfur is fed into said reactor together with a solvent.

18. The process of claim 17 wherein said solvent comprises carbon disulfide.

19. The process of claim 1 further comprising the step of intimately mixing said sulfur and said explosive together.

20. A process for decomposing an explosive, said process comprising the steps of (a) intimately mixing sulfur and said explosive together, (b) reacting said sulfur and said explosive together in a reactor under a substantially oxygen-free atmosphere at a reaction temperature in the range of between about 20 to about 1.5 degrees C. below the autodetonation temperature of said explosive at a pressure of about 1 to about 2 atmospheres and for a sufficient period of time to yield non-explosive reaction products; and (c) reacting vaporized sulfur and one or more of said reaction products together under a substantially oxygen-free atmosphere at a temperature in the range of from about 500° C. to about 1500° C. so as to form a chemically inert, solid composition of matter composed substantially of carbon and sulfur.

21. The process of claim 20 wherein the temperature in step (b) is in the range of between about 10 to about 1.5 degrees C. below the autodetonation temperature of said explosive.

22. The process of claim 20 wherein said explosive is contained within a munition and said sulfur is fed into said reactor in step (b) as a solution of sulfur in a solvent.

* * * * *